United States Patent [19]

Usui et al.

[11] 4,397,792

[45] Aug. 9, 1983

[54] THROTTLE VALVE LINKAGE FOR USE WITH MULTI-CARBURETOR ASSEMBLY

[75] Inventors: Toshifumi Usui, Katsuta; Takashige Kohno, Hitachi; Tadao Osawa, Katsuta; Tokihiko Sakuma, Hitachi, all of Japan

[73] Assignee: Hitachi, Ltd., Tokyo, Japan

[21] Appl. No.: 326,429

[22] Filed: Dec. 1, 1981

[30] Foreign Application Priority Data

Dec. 4, 1980 [JP] Japan ..... 55-171816

[51] Int. Cl.[3] ..... F02M 13/02

[52] U.S. Cl. ..... 261/23 A; 123/59 PC; 74/96

[58] Field of Search ..... 123/59 PC; 74/96; 261/23 A

[56] References Cited

U.S. PATENT DOCUMENTS

| | | | |
|---|---|---|---|
| 1,639,403 | 8/1927 | Fitzgerald | 74/96 |
| 2,237,530 | 4/1941 | Olley | 74/96 |
| 2,366,199 | 1/1945 | Kunz | 74/96 |
| 3,022,928 | 2/1962 | Ulmitz | 74/96 |
| 3,030,819 | 4/1962 | Edelbrock, Jr. | 123/59 PC |
| 4,016,838 | 4/1977 | Yoshioka et al. | 123/59 PC |
| 4,112,826 | 9/1978 | Cataldo | 74/96 |
| 4,207,273 | 6/1980 | Siegmund | 261/23 A |
| 4,261,304 | 4/1981 | Yamada | 123/59 PC |
| 4,305,249 | 12/1981 | Schmid et al. | 261/23 A |

*Primary Examiner*—Tim R. Miles

*Attorney, Agent, or Firm*—Antonelli, Terry & Wands

[57] ABSTRACT

A throttle valve linkage for use with a multi-carburetor assembly comprising a pair of carburetors has first and second levers secured respectively to the throttle shafts of the first and second carburetors, first and second link members respectively connected at one ends to the free ends of the first and second levers. The other ends of the first and second link members are pivotally connected by a common pivot pin which is slidably movable in a guide channel. The rotation of the first carburetor throttle shaft is transmitted by the linkage to the second carburetor throttle shaft so that the latter is rotated in a direction opposite to the direction of rotation of the first carburetor throttle shaft.

16 Claims, 17 Drawing Figures

THROTTLE VALVE LINKAGE FOR USE WITH MULTI-CARBURETOR ASSEMBLY

BACKGROUND OF THE INVENTION

1. Field of the Invention

The present invention relates to carburetors and, more particularly, to a throttle valve linkage for use with a multi-carburetor assembly comprising a plurality of carburetors disposed between engine cylinders arranged in a pair or pairs, as in the case of V-type engine for two-wheeled vehicles, each carburetor being provided for one of the cylinders.

2. Description of the Prior Arts

The type of engines has been known in the field of two-wheeled vehicles which has a plurality of cylinders arranged in a row extending transversely of the longitudinal axis of the vehicle. In this type of engines, carburetors are arranged also in a row transverse to the longitudinal axis of the vehicle so that the throttle shafts of these carburetors are disposed on a common axis. In this case, therefore, there is no substantial difficulty in designing and constructing a throttle valve linkage for operating the throttle valves of all carburetors similarly and in synchronization.

This type of engine, however, inevitably has a large length in the direction transverse to the longitudinal axis, i.e., the running direction, of the vehicle and makes the operation of the two-wheeled vehicle difficult.

Under this circumstance, in recent years, two-wheeled vehicles have been put into use which are designed to have V-type engines in each of which a plurality of cylinders are arranged in V-shape as viewed from lateral side of the vehicle. In this type of engine, a multi-carburetor assembly comprising a plurality of carburetors provided each for one cylinder, are disposed in a limited space between the cylinders arranged in a pair or pairs. The multi-carburetor assembly is arranged such that the direction of suction of air by a first carburetor associated with a first cylinder is opposite to that of a second carburetor associated with a second cylinder and the throttle valves of these carburetors are not arranged on a common axis but are mounted on separate throttle shafts having parallel axes spaced from each other. The two throttle shafts are connected to each other by means of a wire which is wound at both ends thereof in opposite directions around two throttle shafts. One of the throttle shafts is operatively connected to an accelerator adapted to be operated by the driver. As the driver operates the accelerator for accelerating the vehicle, the throttle shaft operatively connected to the accelerator and, hence, the throttle valve carried by this throttle shaft are rotated in one direction. Simultaneously, the rotation of this throttle shaft is transmitted to the other throttle shaft through the wire to rotate the other throttle shaft and the throttle valve in the direction opposite to the direction of rotation of the first-mentioned throttle shaft and throttle valve. The first-mentioned throttle shaft and throttle valve directly operated by the accelerator will be referred to as "driving throttle shaft and throttle valve," while the throttle shaft and throttle lever driven through the wire will be referred to as "driven throttle shaft and throttle valve," hereinafter.

The conventional wire-type throttle linkage between the driving and driven throttle shafts involves the following problems. Namely, this conventional linkage cannot provide good synchronism and similarity of operation of two throttle valves. More specifically, the operation of the driven throttle valve tends to be lagged behind the operation of the driving throttle valve particularly in a part throttle engine operation range. In addition, the wire is undesirably elongated in a relatively short period of time due to the tension applied thereto and deteriorates the synchronism and similarity of operations of the two throttle valves.

The prior art throttle valve linkage which utilizes a wire is not satisfactory because of the problems discussed above, although the prior art linkage can be installed in a limited space.

SUMMARY OF THE INVENTION

It is an object of the present invention to provide an improved throttle valve linkage for use with a multi-carburetor assembly including at least one pair of carburetors disposed between engine cylinders arranged in pair, each carburetor being associated with one of said cylinders, said carburetors being arranged such that the direction of the intake air through one of said carburetors is opposite to the direction of the intake air through the other carburetor, the carburetors having throttle shafts extending substantially in parallel relationship to each other and being adapted to be rotated in the opposite directions by operation of an accelerator to thereby open and close the throttle valves of the carburetors.

It is another object of the present invention to provide an improved throttle valve linkage of the class specified above and which does not utilize wire, can be installed within a limited space and is operative to transmit the rotation of the throttle shaft of one of the carburetors to the throttle shaft of the other carburetor so that the direction of rotation of the other carburetor throttle shaft is inverted.

The throttle valve linkage according to the present invention comprises:

first and second levers adapted to be rotated with said throttle shafts of said first and second carburetors, respectively;

first and second link members pivotally connected at their one ends to the free ends of said first and second levers, respectively;

a common pivot pin pivotally connecting the other ends of said first and second link members;

means defining a substantially elongated guide channel for slidably guiding said common pivot pin;

one of said throttle shafts being operatively connected to said accelerator;

the arrangement being such that the rotation of said one throttle shaft is transmitted to the other throttle shaft so that the direction of the rotation of said other throttle shaft is inverted.

The throttle valve linkage according to the present invention having the construction and arrangement briefly discussed above does not utilize wire which is essentially used in the prior art throttle valve linkage. Accordingly, the problem due mainly to the elongation of the wire is eliminated in the throttle valve linkage of the invention. This greatly improves the response of operation of the driven throttle valve to that of the driving throttle valve. In addition, the throttle valve linkage according to the present invention can be mounted in an extremely narrow space.

The above and other objects, features and advantages of the invention will become more apparent from the following description of preferred embodiments in conjunction with the accompanying drawings.

DESCRIPTION OF PREFERRED EMBODIMENTS

Figure 1:
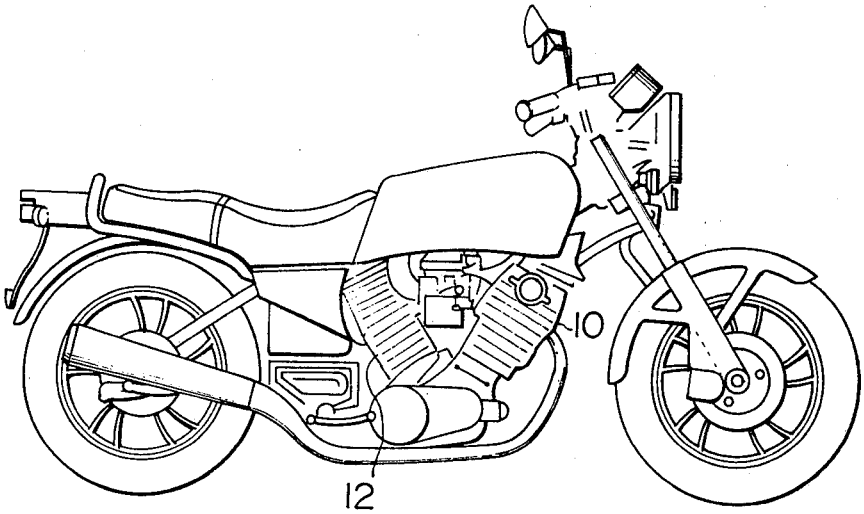
FIG. 1 is a side elevational view of a two-wheeled vehicle having a V-type engine incorporating a multi-carburetor assembly equipped with a throttle linkage of the invention.
Figure 2:
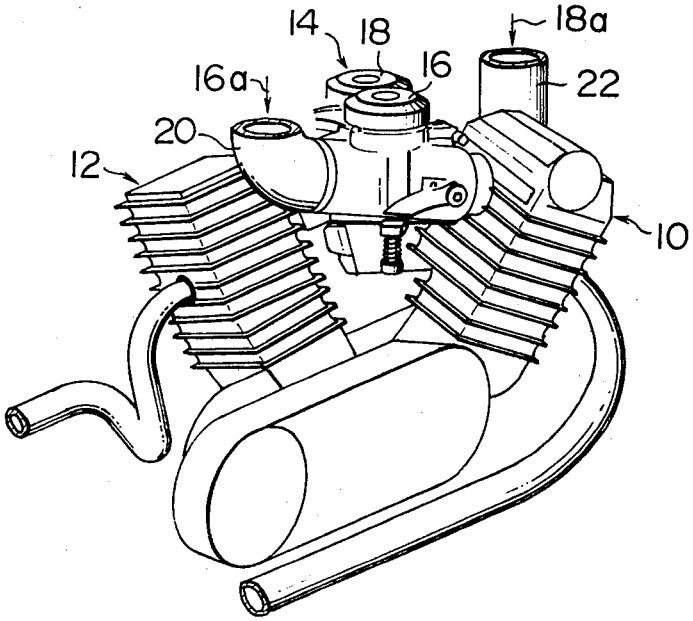
FIG. 2 is an enlarged perspective view of the engine shown in FIG. 1.

FIG. 1 shows a two-wheeled vehicle having a V-type engine unit including first and second cylinders 10, 12 arranged in V shape as viewed in the direction transverse to the longitudinal axis of the vehicle. A multi-carburetor assembly 14 is disposed in the V-shaped or triangular space defined between the two cylinders 10, 12. The multi-carburetor assembly consists of a carburetor 16 for the first cylinder 10 and a carburetor 18 for the second cylinder 12. These two carburetors 16, 18 are so arranged that they suck intake air in opposite directions. Namely, as will be most clearly seen in FIG. 2, an air horn 20 of the first carburetor 16 is disposed in the vicinity of the second cylinder 12, while an air horn 22 of the second carburetor 18 is disposed in the vicinity of the first cylinder 10, so that the intake air to be supplied to both cylinders 10, 12 flows into the air horns 20, 22 of the carburetors 16, 18 as indicated by arrows 16*a*, 18*a*, respectively.

Figure 3:
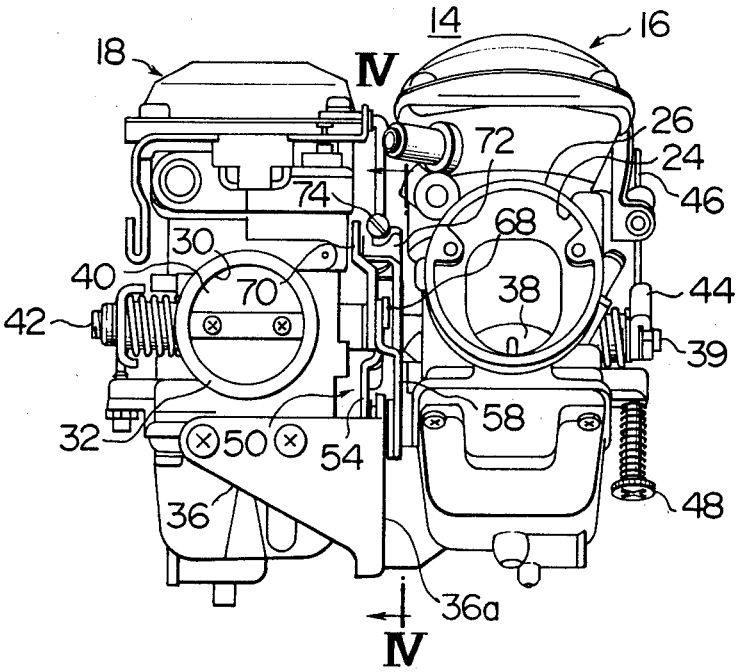
FIG. 3 is a front elevational view of the multi-carburetor assembly shown in FIGS. 1 and 2.
Figure 4:
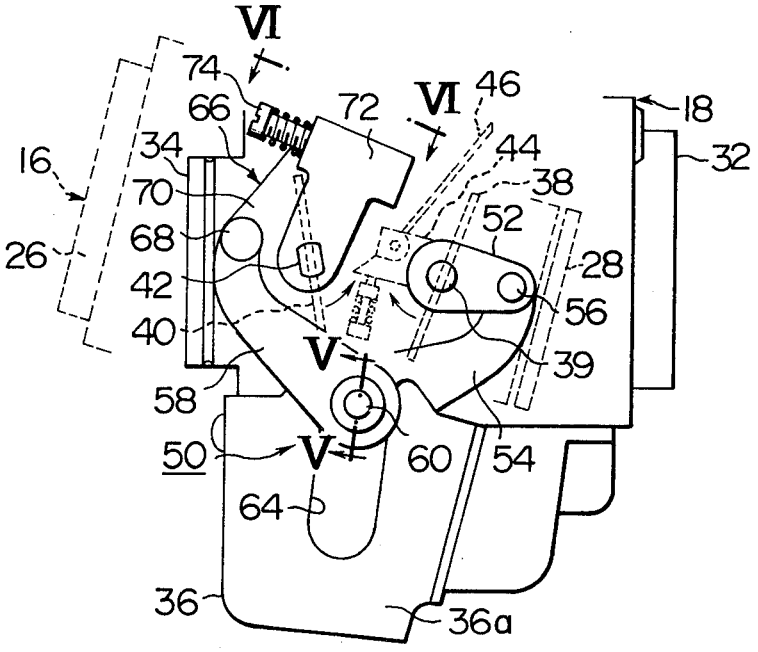
FIG. 4 is a side elevational view of an embodiment of the throttle linkage of the invention taken along line IV—IV in FIG. 3.

Referring now to FIGS. 3 and 4, an intake air passage 24 of the first carburetor 16 has an upstream end 26 connected to the air horn 20 and a downstream end 28 connected to the intake port of the cylinder 10. Similarly, an intake air passage 30 of the second carburetor 18 has an upstream end 32 connected to the air horn 22 and a downstream end 34 connected to the intake port of the cylinder 12. As will be best seen in FIG. 4, the upstream end 26 of the intake air passage 24 of the first carburetor 16 and the downstream end 34 of the intake air passage 30 of the second carburetor 18 are disposed at one side (i.e., at the left side) of the multi-carburetor assembly 14, as viewed in FIG. 4, while the downstream end 28 of the intake air passage 24 of the first carburetor 16 and the upstream end 32 of intake air passage 30 of the second carburetor 18 are disposed at the other side (i.e., at the right side) of the carburetor assembly 14, as viewed in FIG. 4. These carburetors 16, 18 are connected to each other at their lower ends by means of a connector 36 (which is generally called as "bracket") to form the multi-carburetor assembly.

Butterfly-type throttle valves 38, 40 are disposed in the intake air passages 24, 30 of the first and second carburetors 16, 18, respectively. These throttle valves 38, 40 are fixed to throttle shafts 39, 40 rotatably mounted on the carburetors 16, 18 and extending therethrough transversely of respectively intake air passages 24, 30 and are rotatable together with these throttle shafts 39, 40. An arm 44 is fixed at its one end to the end of the throttle shaft 39 opposite to the carburetor 18, while the other end of the arm 44 is connected to a wire 46 of an accelerator. The idle position of the throttle valve 38 is adjustable by means of an adjust screw 48.

The throttle shafts 39, 42 are disposed on two separate axes extending substantially in parallel with each other, as shown in FIG. 4. These throttle shafts 39, 42 are drivingly connected to each other at their inner ends, i.e., at their adjacent ends, by means of a throttle valve linkage 50. The arrangement is such that, when the accelerator is operated in the accelerating direction, the throttle valve 38 of the first carburetor 16 is rotated clockwisely as viewed in FIG. 4 and this rotation is inverted and transmitted to the throttle shaft 42 of the second carburetor 18 by the throttle valve linkage 50. For this reason, the throttle valve 38 and the throttle shaft 39 associated with the first carburetor will be referred to hereunder as "driving throttle valve and throttle shaft" while the throttle valve 40 and the throttle shaft 42 associated with the second carburetor 18 will be referred to as "driven throttle valve and throttle shaft."

Figure 5:
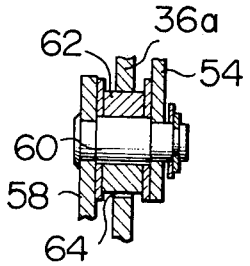
FIG. 5 is a sectional view of the throttle linkage taken along line V—V in FIG. 4.
Figure 6:
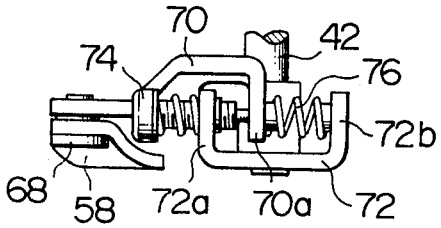
FIG. 6 is an enlarged view of a part of the throttle linkage taken along line VI—VI in FIG. 4.

The throttle valve linkage 50 will be described in more detail with specific reference to FIGS. 4 to 6. The throttle valve linkage 50 includes a layer 52 fixed to the driving throttle shaft 39. The lever 52 is pivotally connected at its free end to the upper end of a first link member 54 by means of a pivot pin 56. The first link member 54 is pivotally connected at its lower end by a pin 60 to the lower end of a second link member 58 having a shape similar to that of the first link member 54. As will be seen in FIG. 5, a roller 62 made of a wear-resistant material such as a sintered metal is rotatably mounted on the pivot pin 60 between the two link members 54, 58. The afore-mentioned bracket 36 has a flattened portion 36*a* extending substantially in the same plane as the throttle linkage 50. An upwardly opened elongated slot or notch 64 is formed in the flattened portion 36*a* and receives the roller 62 as shown in FIG. 5.

The link member 58 is pivotally connected at its upper end to one end of a lever unit 66 by a pivot pin 68. The lever unit 66 includes a substantially L-shaped lever 70 pivotally connected at its central portion to the link member 58 and rotatably mounted at its one end on the driven throttle shaft 42, a lever 72 fixed at its lower end to the throttle shaft 42, and an adjust screw 74 adjustably connecting the upper end of the lever 72 and the other end of the L-shaped lever 70. More specifically, the lever 72 has a substantially U-shaped upper end constituted by two arms 72*a*, 72*b* between which is placed a bent upper end 70*a* of the L-shaped lever 70. The adjust screw 74 extends through a threaded hole formed in the arm 72*a* of the lever 72 and makes a contact at its end with the bent upper end 70*a* of the lever 70. A compression spring 76 is disposed between the upper end 70*a* of the lever 70 and the arm 72*b* of the lever 72 to normally bias the upper end 70*a* of the lever 70 into contact with the inner end of the adjust screw 74. It is possible to adjust the idle position of the driven throttle valve 40 by rotating the adjust screw 74. Once the adjustment is made, the levers 70, 72 and the adjust screw 74 rotate as a unit about the axis of the throttle shaft 42 in accordance with the movement of the second link member 58. For this reason, the lever unit 66 constituted by these three members 70, 72, 74 will be regarded and mentioned hereunder as a single lever for the purpose of simplification of description.

In the throttle valve linkage having the described construction, when the accelerator is operated to rotate the driving throttle valve 38 from the idle position in the clockwise direction as indicated by an arrow showing in FIG. 4, the lever 52 is rotated in the same direction to move the link member 54 downwards. As stated before, the roller 60 is attached to the lower end of the link member 54 through the pivot pin 60 and is received in the slot-like notch 64, so that the downward movement of the link member 54 is guided by the notch 64.

The downward movement of the roller 62 causes a downward movement of the other link member 58 so that the lever 66 is rotated counter-clockwise together with the driven throttle shaft 42 and the driven throttle valve 40.

Figure 7:
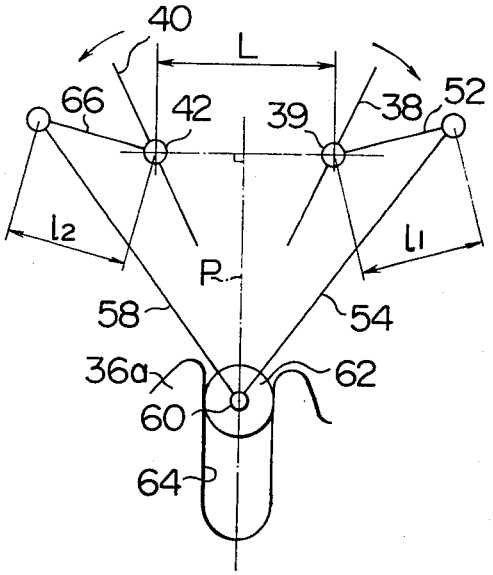
FIG. 7 is a schematic illustration of the link mechanism shown in FIG. 4.
Figure 11:
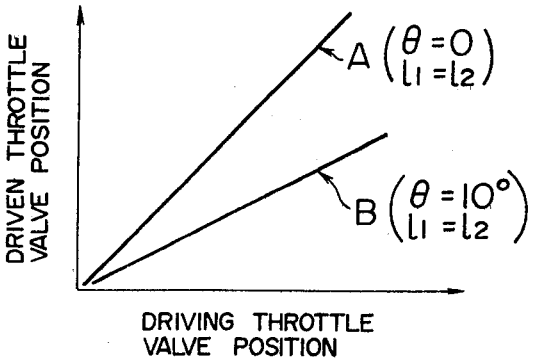
FIG. 11 is a graph showing the operation characteristic of the second embodiment in comparison with that of the first embodiment.
Figure 13:
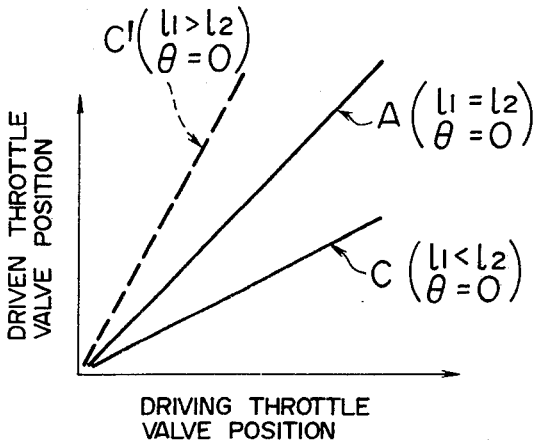
FIG. 13 is a graph showing the operation characteristic of the third embodiment in comparison with that of the first embodiment.
Figure 17:
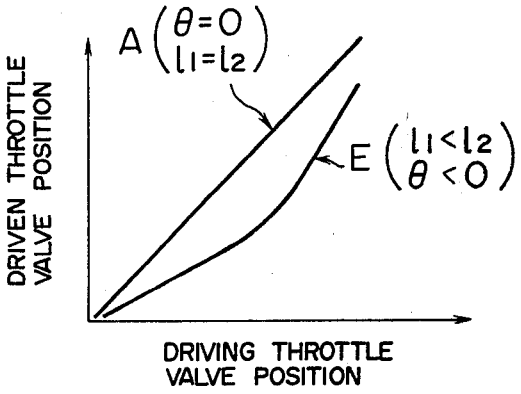
FIG. 17 is a graph showing the operation characteristics of the fifth embodiment in comparison with that of the first embodiment.

Referring now to FIG. 7, a line P is a bisector line which is perpendicular to a line L interconnecting the axes of the two throttle shafts 39, 42 and divides the line L into two sections of equal lengths. In the embodiment described in connection with FIGS. 3 to 6, the longitudinal axis of the notch 64 for guiding the movement of the roller 62 coincides with the above-mentioned line P. In addition, the length $l_1$ of the lever 52 is substantially equal to the effective length $l_2$ of the lever 66 and the link members 54 and 58 have substantially equal lengths. Therefore, when the driving throttle valve 38 has been rotated to a certain position, the driven throttle valve 40 is rotated to a position of an opening degree substantially equal to that of the driving throttle valve 38. This operation characteristic is represented by straight lines A shown in FIGS. 11, 13 and 17.

Figure 8:
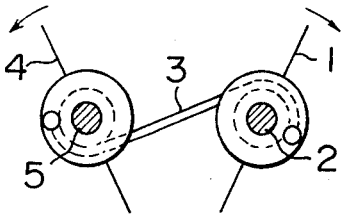
FIG. 8 PRIOR ART
FIG. 8 is an illustration of the prior art.
Figure 9:
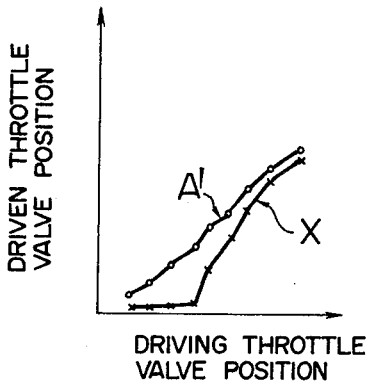
FIG. 9 is a graph showing the operation characteristic of the embodiment shown in FIGS. 4 and 7 in comparison with the operation characteristic of the prior art shown in FIG. 8.

On the other hand, in the prior art throttle valve linkage shown in FIG. 8, a wire 3 is wound at its one end around a throttle shaft 2 of a driving throttle valve 1 and at its other end around a throttle shaft 5 of a driven throttle valve 4 in the direction opposite to the direction of winding of the first-mentioned end, so that the rotation of the driving throttle valve 1 is inverted and transmitted to the driven throttle valve 4. In this prior art linkage, however, the opening degree of the driven throttle valve 4 is considerably small as compared with that of the driving throttle valve 1 especially in the part-throttle engine operating range, as represented by a curve X in FIG. 9. This is believed to be due to the fact that, in the initial stage of the throttle opening operation, the tension force applied to the wire 3 by the driving throttle shaft 2 is effective only to tighten the twist of the wire 3 and, therefore, cannot be used effectively to drive the driven throttle shaft 5.

This problem is completely eliminated in the throttle valve linkage of the invention. Namely, the throttle valve linkage of the invention permits the driving and driven throttle valves 38, 40 to be opened at a substantially equal rate, as indicated by a line A' in FIG. 9.

As has been described, the throttle valve linkage according to the invention links the driving and driven throttle shafts in such a manner that the driven throttle valve is opened substantially at the same rate as the driving throttle valve, so that an air-fuel mixture is charged into the first and second cylinders 10, 12 through respective carburetors 16, 18 at a substantially equal rate. Considered theoretically, this will ensure equal outputs from both cylinders as a result of combustion of the mixture charges into these cylinders.

Some of the multi-cylinder engines incorporating the throttle valve linkage of the above-described embodiment, however, will have a problem that there is a difference in the level of output between the first and second cylinders. Referring to the V-type engine shown in FIG. 2, as an example, the exhaust pipe connected to the first cylinder 10 is bent at a radius of curvature which is as large as possible to ensure a smooth flow of the exhaust gas, whereas the exhaust pipe connected to the rear-side cylinder, i.e., the second cylinder 12, is inevitably curved at a much smaller radius of curvature as compared with that of the exhaust pipe of the first cylinder 10 due to the limitation in the space. In consequence, the exhaust gas from the second cylinder encounters a higher resistance that the resistance to the exhaust gas from the first cylinder, with a resultant higher back pressure against the second cylinder than against the first cylinder. As a result, there occurs an desirable tendency that the second cylinder produces an output which is appreciably smaller than the output from the first cylinder.

In the engines having a difference in output between the first and second cylinders, therefore, it is desired to equalize the outputs from both cylinders by supplying the mixture at a greater rate in to the cylinder of the smaller output than into the cylinder of the larger output. To cope with this desirability, the present inventors propose the following embodiments.

Figure 10:
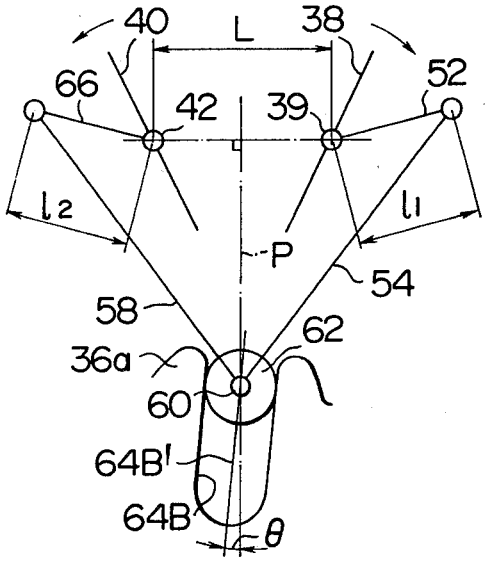
FIG. 10 is a schematic illustration of a throttle linkage constructed in accordance with a second embodiment of the invention.

Referring to FIG. 10 showing a second embodiment of the invention, the length $l_1$ of the lever 52 is equal to the length $l_2$ of the lever 66 and the link members 54, 58 are designed to have equal lengths. In this embodiment, however, the slot-like notch 64 for guiding the roller 62 is inclined. More specifically, the longitudinal axis 64B' of the slot-like notch 64B is inclined to the aforementioned line P at an angle $\theta$ which is 10° in this case. The operation characteristic of this throttle valve linkage is shown by a line B in FIG. 11. It will be seen that the driven throttle valve is opened at a greater degree than the driving throttle valve. The line A represents the operation characteristics of the first embodiment, as pointed out previously.

Figure 12:
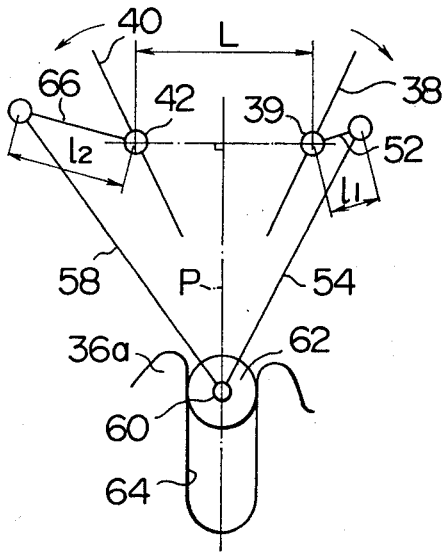
FIG. 12 is a schematic illustration of a throttle linkage constructed in accordance with a third embodiment of the invention.

In a third embodiment shown in FIG. 12, the axis of the notch 64 coincides with the line P; namely, the angle $\theta$ is zero. In this case, however, the lever 52 is designed to have a length $l_1$ which is smaller than the length $l_2$ of the lever 66. The throttle valve linkage of this third embodiment exhibits an operation characteristic graphically shown by a line C in FIG. 13 which resembles the line B representing the operation characteristic of the second embodiment. It will be apparent to those skilled in the art that an operation characteristic represented by a broken line C' is obtained by modifying the third embodiment shown in FIG. 12 such that the length $l_1$ is greater than the length $l_1$. As stated before, the line A represents the operation characteristic of the first embodiment.

Figure 14:
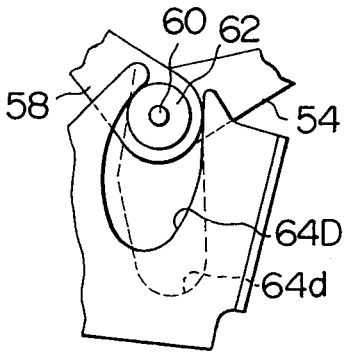
FIG. 14 is a side elevational view of a part of a throttle linkage constructed in accordance with a fourth embodiment, in which a broken line illustrates a modification.
Figure 15:
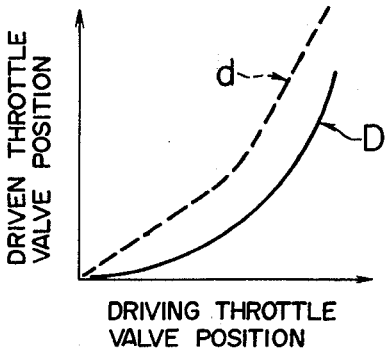
FIG. 15 is a graph showing the operation characteristics of the fourth embodiment and the modification thereof.

In the fourth embodiment shown in FIG. 14, the notch 64D has a substantially oval shape. The left side edge portion of this notch 64D is curved to present an arcuate form to guide the roller 62. In a modification of this embodiment shown by a broken line, the notch **64*d* has a left side edge portion curved to present a laterally directed or turned V shape for guiding the roller 62. Curves D and d shown in FIG. 15 represent the operation characteristic of the fourth embodiment having the notch 64D and its modification having the notch 64*d*, respectively. The operation characteristics shown in FIG. 15 are useful in the case where the throttle valve of one of the carburetors, namely, the carburetor 18 associated with the cylinder 12, is designed to have a throttle opening characteristic which is more moderate or less sharp than that of the throttle valve of the other carburetor 16 so that the output of the cylinder 12 is prevented from being sharply varied in the part throttle engine operation range to thereby assure an improved engine drivability and emission control performance. It will be apparent to those in the art that the notches 64D and 64*d* shown in FIG. 14 may be further modified to have curved right side edges to provide modified operation characteristics which will be substantially opposite to those shown in FIG. 15**.

Figure 16:
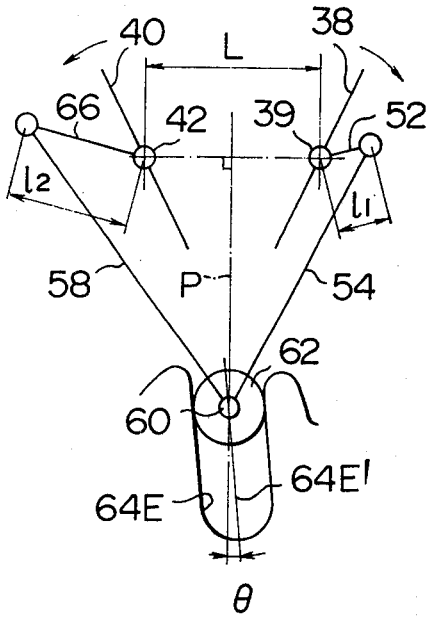
FIG. 16 is a schematic illustration of a link mechanism constructed in accordance with a fifth embodiment of the invention.

In a fifth embodiment of the invention shown in FIG. 16, the length $l_1$ of the lever 52 is smaller than the length $l_2$ of the lever 66 and the notch 64E for guiding the roller 62 is inclined to the line P at an angle $\theta$ in the counterclockwise direction (i.e., $\theta<0$). This embodiment exhibits an operation characteristic represented by a curve E shown in FIG. 17 wherein the line A represents the operation characteristic of the first embodiment of the invention, as pointed out previously.

What is claimed is:

1. A throttle valve linkage for use with a multi-carburetor assembly including at least one pair of carburetors disposed between engine cylinders arranged in pair, each carburetor being associated with one of said cylinders, said carburetors being arranged such that the direction of the intake air flow through one of said carburetors is opposite to the direction of the intake air flow through the other carburetor, said carburetors having throttle shafts extending substantially in parallel relationship to each other and being adapted to be rotated in the opposite directions by operation of an accelerator to thereby open and close the throttle valves of said carburetors, said throttle valve linkage being adapted to be installed between said carburetors and comprising:

first and second levers adapted to be rotated with said throttle shafts of said first and second carburetors, respectively;

first and second link members pivotally connected at their one ends to the free ends of said first and second levers, respectively;

a common pivot pin pivotally connecting the other ends of said first and second link members;

means defining a substantially elongated guide channel for slidably guiding said common pivot pin;

one of said throttle shafts being operatively connected to said accelerator;

the arrangement being such that the rotation of said one throttle shaft is transmitted to the other throttle shaft so that the direction of the rotation of said other throttle shaft is inverted.

2. A throttle valve linkage as claimed in claim 1, wherein said first and second levers have substantially equal lengths and wherein the longitudinal axis of said guide channel substantially coincides with a first line which is perpendicular to a second line joining the axes of said throttle shafts and divides said second line into two sections of equal lengths.

3. A throttle valve linkage as claimed in claim 1, wherein said first and second levers have substantially equal lengths and wherein the longitudinal axis of said guide channel is inclined at a predetermined angle to a first line which is perpendicular to a second line joining the axes of said throttle shafts and divides said second line into two sections of equal lengths.

4. A throttle valve linkage as claimed in claim 1, wherein said first and second levers have different lengths and wherein the longitudinal axis of said guide channel substantially coincides with a first line which is perpendicular to a second line joining the axes of said throttle shafts and divides said second line into two sections of equal lengths.

5. A throttle valve linkage as claimed in claim 1, wherein at least one side edge of said guide channel is curved toward the longitudinal axis of said guide channel.

6. A throttle valve linkage as claimed in claim 1, wherein said first and second levers have different lengths and wherein the longitudinal axis of said guide channel is inclined at a predetermined angle to a first line which is perpendicular to a second line joining the axes of said throttle shafts and divides said second line into two sections of equal lengths.

7. A throttle valve linkage as claimed in any one of claims 1 to 6, wherein said guide channel defining means comprises a connector connecting said first and second carburetors together.

8. A throttle valve linkage as claimed in any one of claims 1 to 6, wherein said first lever is fixed to the throttle shaft of said first carburetor and said second lever includes a first rotatable member pivotally connected to said second link member, a second rotatable member fixed to the throttle shaft of said second carburetor and means drivingly connecting the free ends of said first and second rotatable members, said connecting means including an adjust screw for adjusting the idle position of said second carburetor throttle valve.

9. A multi-carburetor assembly for use with a V-type engine for two-wheeled vehicles, said engine having a pair of cylinders arranged in V shape as viewed in a direction transverse to the longitudinal axis of said vehicle to define a space therebetween, said multi-carburetor assembly being adapted to be installed in said space and comprising:

first and second carburetors adapted to be attached to first and second cylinders, respectively;

means connecting said first and second carburetors together into a unit;

each carburetor defining therein an intake passage adapted to be connected to the intake port of an associated cylinder, a throttle valve rotatably mounted in said intake passage and a throttle shaft supporting said throttle valve;

the throttle shafts of said first and second carburetors extending substantially in parallel relationship to each other; and a throttle valve linkage disposed between said first and second carburetor and drivingly connecting said throttle shafts of said first and second carburetors;

said throttle valve linkage comprising:

first and second levers adapted to be rotated with said throttle shafts of said first and second carburetors, respectively;

first and second link members pivotally connected at their one ends to the free ends of said first and second levers, respectively;

a common pivot pin pivotally connecting the other ends of said first and second link members;

means defining a substantially elongated guide channel for slidably guiding said common pivot pin;

one of said throttle shafts being operatively connected to said accelerator;

the arrangement being such that the rotation of said one throttle shaft is transmitted to the other throttle shaft so that the direction of the rotation of said other throttle shaft is inverted.

10. A multi-carburetor assembly as claimed in claim 9, wherein said first and second levers have substantially equal lengths and wherein the longitudinal axis of said guide channel coincides with a first line which is perpendicular to a second line joining the axes of said throttle shafts and divides said second line into two sections of equal lengths.

11. A multi-carburetor assembly as claimed in claim 9, wherein said first and second levers have substantially equal lengths and wherein the longitudinal axis of said guide channel is inclined at a predetermined angle to a first line which is perpendicular to a second line joining the axes of said throttle shafts and divides said second line into two sections of equal lengths.

12. A multi-carburetor assembly as claimed in claim 9, wherein said first and second levers have different lengths and wherein the longitudinal axis of said guide channel substantially coincides with a first line which is perpendicular to a second line joining the axes of said throttle shafts and divides said second line into two sections of equal lengths.

13. A multi-carburetor assembly as claimed in claim 9, wherein at least one side edge of said guide channel is curved toward the longitudinal axis of said guide channel.

14. A multi-carburetor assembly as claimed in claim 9, wherein said first and second levers have different lengths and wherein the longitudinal axis of said guide channel is inclined at a predetermined angle to a first line which is perpendicular to a second line joining the axes of said throttle shafts and divides said second line into two sections of equal lengths.

15. A multi-carburetor assembly as claimed in any one of claims 9 to 14, wherein said guide channel defining means comprising a connector connecting said first and second carburetors together.

16. A multi-carburetor assembly as claimed in any one of claims 9 to 14, wherein said first lever is fixed to the throttle shaft of said first carburetor and said second lever includes a first rotatable member pivotally connected to said second link member, a second rotatable member fixed to the throttle shaft of said second carburetor and means connecting the free ends of said first and second rotatable members, said connecting means including an adjust screw for adjusting the idle position of said carburetor throttle valve.

* * * * *